US011346159B1

(12) United States Patent
Smith

(10) Patent No.: US 11,346,159 B1
(45) Date of Patent: May 31, 2022

(54) RUGGEDIZED BIDIRECTIONAL CUTTING SYSTEM

(71) Applicant: FRANK'S INTERNATIONAL LLC., Houston, TX (US)

(72) Inventor: Lee Morgan Smith, Anchorage, AK (US)

(73) Assignee: FRANK'S INTERNATIONAL LLC., Houston, TX (US)

( * ) Notice: Subject to any disclaimer, the term of this patent is extended or adjusted under 35 U.S.C. 154(b) by 0 days.

(21) Appl. No.: 16/899,451

(22) Filed: Jun. 11, 2020

(51) Int. Cl.

| | |
|---|---|
| ***E21B 10/46*** | (2006.01) |
| ***E21B 12/04*** | (2006.01) |
| ***E21B 17/10*** | (2006.01) |
| ***E21B 10/26*** | (2006.01) |
| ***E21B 7/28*** | (2006.01) |

(52) U.S. Cl.
CPC ..... *E21B 10/46* (2013.01); *E21B 7/28* (2013.01); *E21B 10/26* (2013.01); *E21B 12/04* (2013.01); *E21B 17/1078* (2013.01)

(58) Field of Classification Search
CPC ..... E21B 10/46; E21B 12/04; E21B 10/30; E21B 10/265; E21B 10/44; E21B 17/1078
See application file for complete search history.

(56) References Cited

U.S. PATENT DOCUMENTS

| | | | | |
|---|---|---|---|---|
| 3,306,381 A * | 2/1967 | Garrett | E21B 10/30 | 175/346 |
| 4,277,869 A * | 7/1981 | Hartwell | B23P 15/00 | 166/173 |
| 4,717,290 A * | 1/1988 | Reynolds | E21B 10/56 | 407/34 |
| 5,330,016 A * | 7/1994 | Paske | E21B 10/00 | 175/320 |
| 6,695,080 B2 * | 2/2004 | Presley | E21B 10/16 | 175/391 |
| 9,151,119 B1 * | 10/2015 | Smith | E21B 10/26 | |
| 9,428,963 B1 * | 8/2016 | Smith | E21B 7/28 | |
| 10,648,266 B2 * | 5/2020 | Su | E21B 29/06 | |

(Continued)

FOREIGN PATENT DOCUMENTS

KR 101881406 B1 7/2018

OTHER PUBLICATIONS

"Annulus" definition. Available from: https://www.glossary.oilfield.slb.com/Terms/a/annulus.aspx?p=1 (Year: 2020).*

(Continued)

*Primary Examiner* — Blake Michener
*Assistant Examiner* — Theodore N Yao
(74) *Attorney, Agent, or Firm* — Nolte Lackenbach Siegel

(57) ABSTRACT

A ruggedized bidirectional cutting system with an outer wear band having a first blade-free fitting section engaging within the drill string and a first cutting section integral with the first blade-free fitting section. The first cutting section has a plurality of blades, each blade with two cutting portions extending at defined cutting angles and a blade cutting portion extending at a third angle from the longitudinal axis different from the first and second angles. Each blade has cutting inserts. A plurality of flutes are formed between pairs of blades to stabilizes and protects bottom hole equipment while a wellbore completes directional drilling objectives.

20 Claims, 10 Drawing Sheets

(56) References Cited

U.S. PATENT DOCUMENTS

| | | | | |
|---|---|---|---|---|
| 2008/0029308 | A1* | 2/2008 | Chen | E21B 10/16 175/331 |
| 2010/0051349 | A1* | 3/2010 | Ballard | E21B 10/26 175/57 |
| 2013/0161099 | A1* | 6/2013 | Silva | E21B 10/26 175/57 |
| 2014/0246247 | A1* | 9/2014 | Smith | E21B 10/26 175/394 |
| 2015/0285004 | A1 | 10/2015 | Makkar et al. | |
| 2017/0328144 | A1* | 11/2017 | Roberson | E21B 47/017 |
| 2018/0258703 | A1 | 9/2018 | Reilly | |
| 2019/0338601 | A1 | 11/2019 | Smith et al. | |

OTHER PUBLICATIONS

PCT/US2021/036404 International Search Report and Written Opinion of the International Searching Authority, dated Sep. 24, 2021 11 pages.

* cited by examiner

RUGGEDIZED BIDIRECTIONAL CUTTING SYSTEM

FIELD

The present embodiments generally relate to a ruggedized bidirectional cutting system for protecting and engaging a bottom hole assembly for use in a wellbore.

BACKGROUND

A need exists for a cutting and protection system with two parts working independently to protect a drill string or equipment attached to the drill string while providing additional cutting devices at multiple angles to enlarge or smooth a wellbore.

The present embodiments meet these needs.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

Figure 1A:
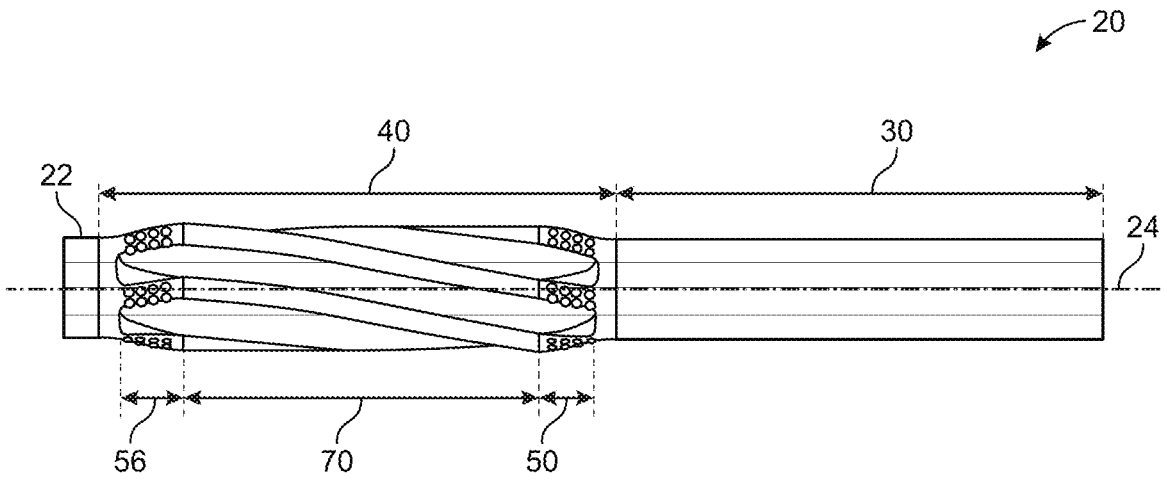
FIGS. 1A and 1B are side views of the first outer wear band and the second outer wear band, respectively, as formed for use according to one or more embodiments.

The present embodiments are detailed below with reference to the listed Figures.

DETAILED DESCRIPTION

Illustrative examples of the subject matter claimed below will now be disclosed. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Before explaining the present system in detail, it is to be understood that the system is not limited to the particular embodiments and that it can be practiced or carried out in various ways and utilized or applied in various ways.

Specific structural and functional details disclosed herein are not to be interpreted as limiting, but merely as a basis of the claims and as a representative basis for teaching persons having ordinary skill in the art to variously employ the presently claimed subject matter.

Disclosed herein is a ruggedized bidirectional cutting system with outer wear band having a first blade-free fitting section engaging within the drill string and a first cutting section integral with the first blade-free fitting section. The first cutting section has a plurality of blades, each blade with two cutting portions extending at defined cutting angles and a blade cutting portion extending at a third angle from the longitudinal axis different from the first and second angles. Each blade having cutting inserts. A plurality of flutes are formed between pairs of blades to stabilize and protect bottom hole equipment while the ruggedized bidirectional cutting system completes directional drilling objectives.

This technology improves directional response of bottom hole assemblies.

This technology improves drilling efficiencies of bottom hole assemblies by drilling smoother with lower vibrations which extends wellbore equipment tool life.

This technology smooths the wellbore allowing the wellbore to be drilled to greater distances.

This technology improves overall safety for the drilling rig by reducing the number of "trips" to drill the well. Tripping inherently has higher risks associated with drilling operations and tripping out can even cause bodily harm to workers at the site or possible death.

This technology reduces excess wear on measurement while drilling (MWD) equipment and on logging tools which wear can cost and operator in excess of 1 million dollars.

Disclosed herein is a ruggedized bidirectional cutting system for protecting and engaging a bottom hole assembly in a wellbore.

The system includes a first outer wear band.

The first outer wear band has a first shaft for slipping around other downhole components.

The drill string connects to a first shaft of the first outer wear band.

The first shaft can be centered around a longitudinal axis.

The first shaft has a first annulus with a first inner diameter. For example, the first shaft could have an outer diameter from 2.5 inches to 40 inches and an inner diameter from 2 inches to 30 inches within the annulus.

The first shaft supports a first blade-free fitting section formed on the first shaft. The first shaft engages within the drill string.

In different embodiments, the first shaft can be eccentrically positioned around the longitudinal axis of the shaft, that is off center of the longitudinal axis.

The blade-free fitting section can have an outer diameter dimension that is the same diameter as the first shaft and to up to 50% greater than the first shaft outer diameter.

The blade-free fitting section can have a length from 0.5 inches to 45 feet.

In embodiments, the blade-free fitting section has a length from 10% to 50% and up to 60% of the length of the first shaft.

The first shaft has a first cutting section integral with, that is, seamlessly formed with, the blade-free fitting section.

The first cutting section has a cutting section outer diameter and a plurality of first blades. The first cutting section can have a length from 1 inch to 40 inches. The first cutting section has a cutting section outer diameter 5% to 40% larger than the drill string outer diameter.

From 2 to 20 first blades can be formed on each first cutting section.

The first cutting section is made from a plurality of first blades with flutes formed between pairs of first blades.

From 2 to 22 flutes can be used in each first cutting section, each flute having a depth into the first shaft from 1% to 25% the thickness of the first shaft.

Each first blade of the first cutting section includes three integral portions, (i) a first cutting portion, (ii) a first blade cutting portion and (iii) a second cutting portion.

The first cutting portion can extend from the first blade-free fitting section at a first cutting angle. The first cutting angle can be from 10 degrees to 55 degrees from the longitudinal axis. The first cutting portion presents a plurality of first cutting inserts to the wellbore.

The first blade cutting portion of the first blade is integrally formed the first cutting portion at a third cutting angle from the longitudinal axis different from the first cutting angle. The blade cutting portion may have a plurality of blade cutting inserts which can range from 3 to 5 and up to 100 or 300 to 353 cutting inserts.

A second cutting portion is integrally formed with the first blade cutting portion extending at a second cutting angle from 10 degrees to 55 degrees from the longitudinal axis of the first shaft. The second cutting portion may have a plurality of second cutting inserts.

Each first cutting insert and second cutting insert can all be one of the following, or a combination of the following: domed tungsten carbide cutting inserts, raised tungsten carbide cutting inserts, polycrystalline diamond compacts, polished polycrystalline diamond compacts, and diamond hard facing cladding.

From 3 to 5, up to 100 to 300 or even 353 cutting inserts can be used in each portion of the first blade. Holes can be pre-machined into the blade outer surface and the outer surfaces of the first and second cutting portions into which the cutting insets can be installed.

In embodiments, a plurality of recessed blade cutting inserts can be installed on the first blade at depths from 10% to 50% and up to 60% of the thickness of the first blade.

The first cutting portion is integral with a blade cutting portion which in turn is integral with a second cutting portion. Each section or portion is formed at a different angle of inclination from the longitudinal axis.

The plurality of first blades are formed in the first shaft cutting section surface can extend 0.25 inches to 25 inches from the cutting section surface.

A plurality of first flutes are formed in the first cutting section forming the first outer wear band.

Each first flute is formed between pairs of first blades. Some flutes can be elliptical, some can be rectangular.

The first outer wear band engages the drill string making up onto either a downhole motor or a rotary steerable tool to stabilize and protect a bottom hole assembly while the wellbore is enlarged while completing directional drilling objectives.

In embodiments, the first blades can be helically formed around the longitudinal axis.

In embodiments, the first blades can be parallel but not helically arranged around the longitudinal axis.

In embodiments, the first blades can be eccentrically positioned around the longitudinal axis.

In embodiments, each of the three portions of the first blade are formed at a different angle from the longitudinal axis, which is a feature of the invention between 10 and 55 degrees.

Another component (iv), "an extension", can be added to the required three portions of each first blade.

In embodiments, from 1 to 20 extensions can be integrally formed between a first cutting portion, the first blade cutting portion, or the second cutting portion and the first blade cutting portion or both.

Each extension between the first cutting portion and the first blade outer surface can be from 0.1 inch to 10 inches wide or from 1% to 50% and up to 60% % the length of the first cutting portion.

Extensions can have identical lengths between the first cutting portion and the first blade cutting portion or can have different lengths.

In embodiments, the thickness of each extension can be the same as the thickness of the first cutting portion.

In embodiments, the thickness of each extension can be from 3% to 100% greater than the thickness of the first cutting portion.

Each extension can contain a plurality of extension machined holes for containing extension cutting inserts formed into a portion of the cutting extension surface.

The extension cutting inserts can be identical in size, shape and material to the cutting inserts used in the first cutting inserts, the second cutting inserts, and the first blade cutting inserts.

In embodiments, the first blades can be helically formed around the cutting section surface or be in parallel or staggered orientation to each other.

In embodiments, the first, second and third cutting angles are different in degrees, that is, at different angles between 10 degrees and 55 degrees.

From 3 to 5 to 100 to 300 to as many as 353 blade cutting inserts can be used.

The blade cutting inserts can be between 1/16 inch to 1 inch in diameter or if the blade cutting inserts are another geometric shape other than round or elliptical, the blade cutting inserts can be between 1/16 inch to 1 inch in width.

In embodiments, a plurality of impact arrestors can be imbedded in portions of the first blade.

Each impact arrestor can be a tungsten carbide arrestor, a ceramic impact arrestor, a polycrystalline diamond impact arrestor, a domed polycrystalline diamond compact arrestor or a diamond impregnated impact arrestor.

Each cutting insert can have a geometric shape that is round, rectangular, square, triangular, octagonal, trapezoidal, or another polygonal shapes.

In embodiments, from 1 to 15 polycrystalline diamond compacts can be installed in the first cutting portion, the second cutting portion, the blade cutting portion or one or more extensions.

In embodiments, first blade cutting inserts have diameters from $3/8^{th}$ inch to 1 inch for a friction fit in one of a plurality of pre-machined holes drilled in the first blade providing a flush engagement of the cutting insert with the first blade outer surface.

In embodiments, a plurality of leading-edge blade cutting inserts can be installed on a leading edge of each first blade.

The first flutes can have a depth into the first shaft from 0.1% and 70% of the thickness of the first shaft.

Between 1 and 16 flutes can be formed in the outer surface of the first shaft. The flutes can vary in width from $1/16^{th}$ of an inch to 10 inches on the outer surface area of the first shaft between blades.

In embodiments, the ruggedized bidirectional cutting system includes a second outer wear band installed between the first outer wear band and the drill string.

The second outer wear band can be identical to the first outer wear band or fall within the above described ranges providing two outer wear bands of two different sizes.

The second outer wear band has a second shaft for slipping around other downhole components.

The second shaft can be centered around a second outer wear band longitudinal axis.

Like the first shaft, the second shaft having a second annulus with a second inner diameter.

The second outer wear band has a second blade-free fitting section formed on the second shaft engaging within the drill string.

The second outer wear band has a second outer wear band cutting section integral with the second blade-free fitting section.

The second outer wear band cutting section has a second outer wear band cutting section outer diameter different in size from a second blade-free fitting section outer diameter.

The second wear band cutting section has a plurality of second blades, each second blade has (i) a second outer wear band first cutting portion extending from the second blade-free fitting section at a second outer wear band first cutting angle that is from 10 degrees to 55 degrees from the longitudinal axis of the second shaft.

The second outer wear band first cutting portion has a plurality of first cutting inserts.

The second outer wear band cutting section has (ii) a second outer wear band blade cutting portion formed with the second outer wear band first cutting portion at a third cutting angle from the longitudinal axis of the second shaft that is an angle different from the second outer wear band first cutting angle.

The blade cutting portion has a plurality of blade cutting inserts.

The second outer wear band cutting section has (iii) a second outer wear band second cutting portion integrally formed with the second outer wear band first blade cutting portion.

The second outer wear band second cutting portion extends at a second cutting angle from 10 degrees to 55 degrees from the longitudinal axis that can be the same as the first cutting angle, but different from the third cutting angle.

The second outer wear band second cutting portion has a plurality of second outer wear band second cutting inserts. From 3 to 300 blade cutting inserts can be installed in pre-machined holes on both the first and second outer wear bands.

Each cutting insert of the second wear band can be a domed tungsten carbide cutting insert, a raised tungsten carbide cutting insert, a polycrystalline diamond compact, a polished polycrystalline diamond compact, a diamond hard facing cladding, or a combination thereof.

The second wear band cutting section has a plurality of second outer wear band second flutes formed between pairs of second outer wear band first blades.

When the first and second outer wear bands are used in the wellbore, the first outer wear band and the second outer wear band engage the drill string making up onto either a downhole motor or a rotary steerable tool in mirror image configurations from each other. With this mirror image configuration, the second outer wear band acts independently of the first outer wear band stabilizing and protecting the bottom hole assembly while the wellbore is enlarged completing directional objectives.

The second outer wear band can have a plurality of recessed blade cutting inserts installed on each of second blades. The recessed blade cutting inserts can be installed in the second blade at depths from 10% to 50% of the thickness of the second blade.

The plurality of recessed blade cutting inserts can be installed at an offset of 1 degree to 15 degrees from a plane formed by each blade outer surface, the offset tilting the recessed blade cutting inserts into a direction of rotation of the outer wear band to minimize rotation friction as the outer wear band rotates.

In embodiments, first engagement threads can be formed in a first direction in the first inner diameter of the first outer wear band engaging the drill string in a first direction and second engagement threads can be formed in a second direction in the second inner diameter of the second outer wear band for engaging the drill string at a different location with an opposite rotation from the first outer wear band to ensure a rugged fit.

In embodiments using two outer wear bands, it should be noted that the first outer wear band can engage a measuring while drilling system connected to the drill string while the second outer wear band simultaneously engages the drill string and another downhole tool.

In embodiments, each outer wear band is eccentrically positioned around the longitudinal axis of each shaft.

In embodiments, a plurality of impact arrestors can be imbedded in portions of the first blade or the second blade, wherein each impact arrestor can be a tungsten carbide arrestor, a ceramic impact arrestor, a polycrystalline diamond impact arrestor, a domed polycrystalline diamond compact arrestor or a diamond impregnated impact arrestor.

In other embodiments, when two outer wear bands are used forming the ruggedized bidirectional cutting system, a single, connected communication wire in each annulus of each outer wear band.

In yet another embodiment, it is contemplated that an electronegative charge layer can be formed within 1% to 15% of the surface of the shaft using ammonium nitrate and heat for reducing balling tendencies while drilling with the outer wear band.

For the second outer wear band, each cutting insert can have a geometric shape that is round, rectangular, square, triangular, octagonal, trapezoidal, or another polygonal shapes.

Figure 1B:
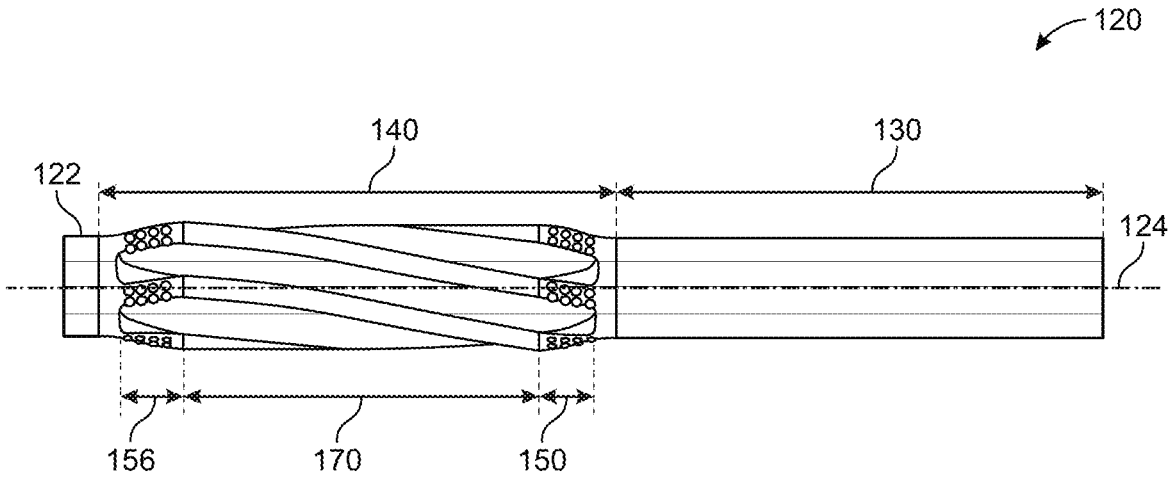
Figure 9:
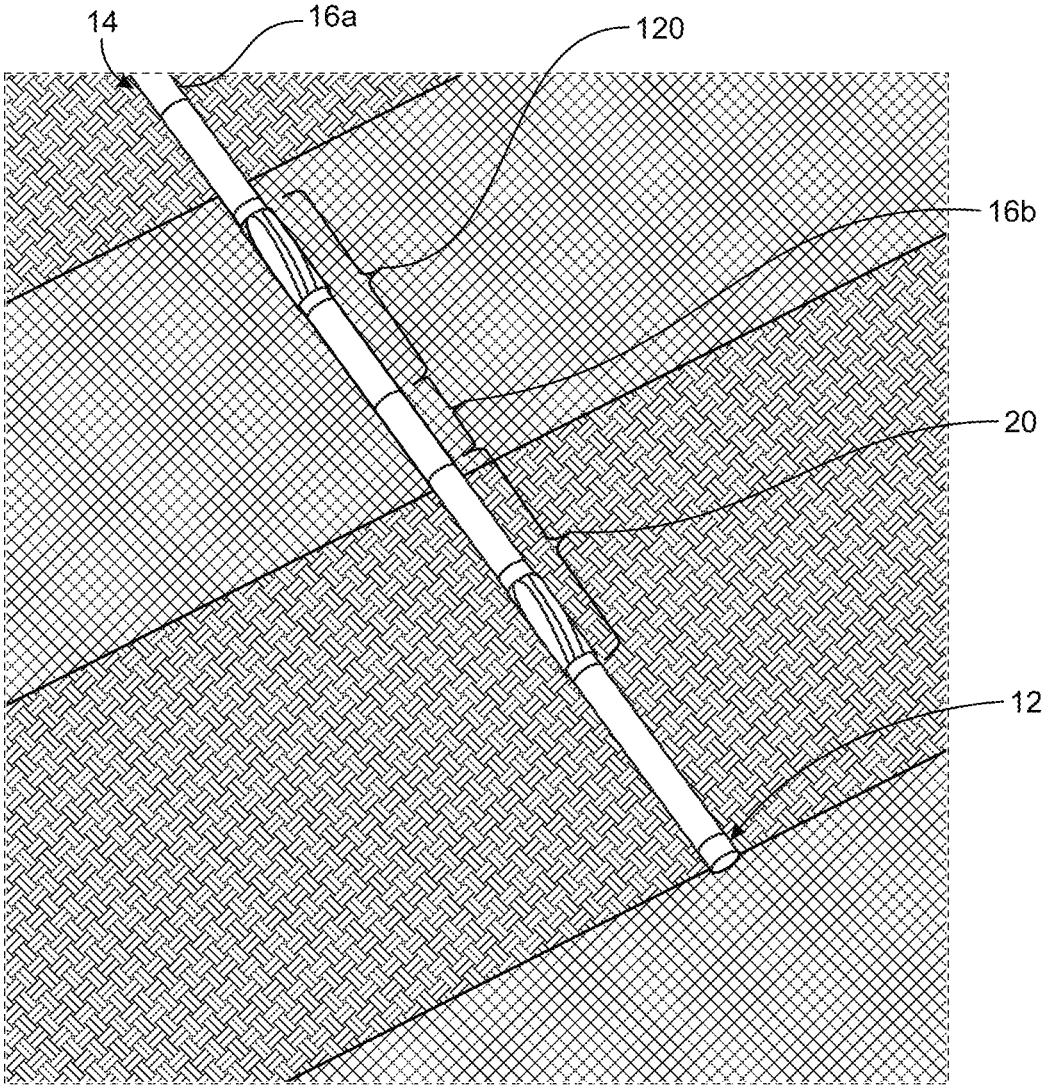
FIG. 9 depicts a first outer wear band attached to a bottom hole assembly on one end, and a segment of drill string on an opposite end while working in a wellbore.

Turning now to the drawings, FIGS. 1A and 1B are a side view of a first outer wear band 20 and a side view of a second outer wear band 120, respectively, of the ruggedized bidirectional cutting system for protecting and engaging a bottom hole assembly 12 shown in FIG. 9 for use in a wellbore 14 also shown in FIG. 9. The first outer wear band 20 engages a drill string 16 shown in FIG. 9.

Returning to FIGS. 1A and 1B, the first outer wear band 20 is shown having a first shaft 22 centered around a longitudinal axis 24.

Figure 3A:
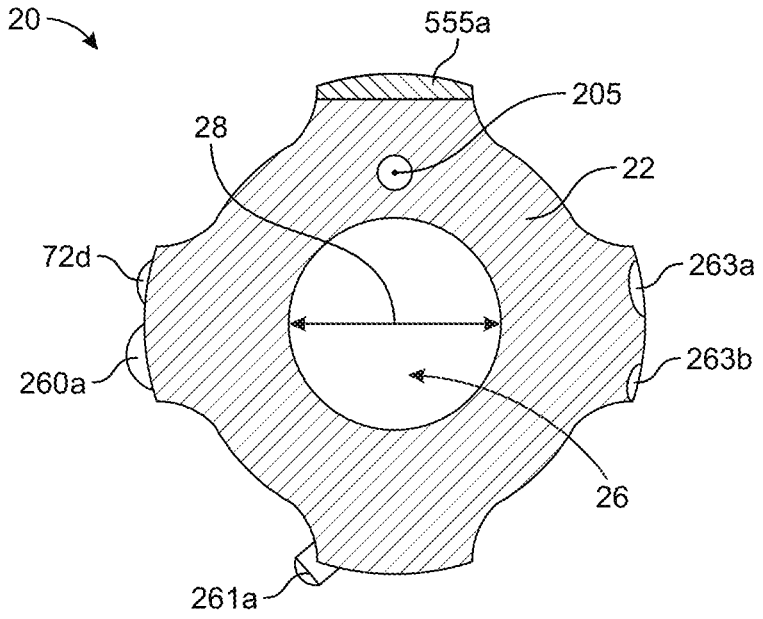
FIGS. 3A and 3B depict a cross sectional view of the cutting section of the first outer wear band of FIG. 1A and FIG. 2A and a cutting section of the second outer wear band of FIG. 1B and FIG. 2B, respectively, according to one or more embodiments.

It should be noted that the first shaft 22 has a first annulus 26 with a first inner diameter 28 shown in FIG. 3A.

Returning to FIG. 1A, the first outer wear band 20 has a first blade-free fitting section 30, engaging within the drill string 16 shown in FIG. 9.

The first outer wear band 20 also has a first cutting section 40 integral with the first blade-free fitting section 30. In this particular embodiment, the first cutting section 40 and the first blade-free fitting section 30 may be considered "segments" of the first outer wear band 20. Note that other embodiments may have different numbers of segments and/or other segments in addition to or in lieu of those shown in the embodiment of FIG. 1A.

To be integral, the first cutting section 40 can be welded to the first blade-free fitting setting 30 or the two segments (i.e., the first cutting section 40 and the blade-free fitting section 30) can be cut from a single piece of a tubular.

FIG. 1A shows that the first outer wear band 20 has a first blade cutting portion 70 integrally formed between a first cutting portion 50 and a second cutting portion segment 56, both of which are angled from the first shaft 22.

Figure 3B:
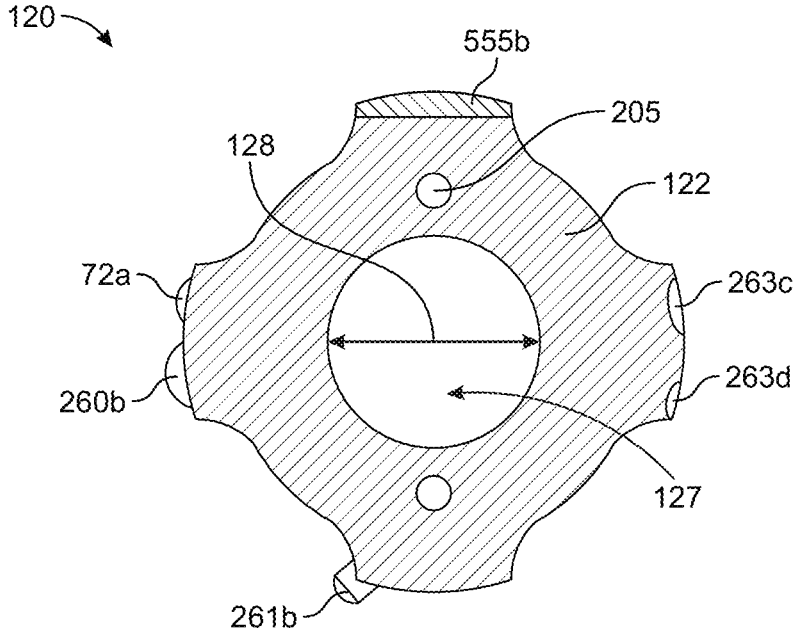

FIG. 1B shows the second outer wear band 120 having a second shaft 122 centered around a second outer wear band longitudinal axis 124. The second shaft 122 defines a second annulus 127 with a second inner diameter 128 as shown in FIG. 3B.

The second outer wear band 120 includes a second blade-free fitting section 130 engaging within the drill string 16 shown in FIG. 9.

The second outer wear band 122 has a second cutting section 140 integral with the second blade-free fitting section 130.

The second outer wear band 122 has a second outer wear band second blade cutting portion 170 integrally formed between a second outer wear band first cutting portion 150 and a second outer wear band second cutting portion segment 156 which are angled from the second shaft 122.

The blades formed in the cutting section are presented in a helically embodiment in these FIGS. 1A and 1B.

Figure 2A:
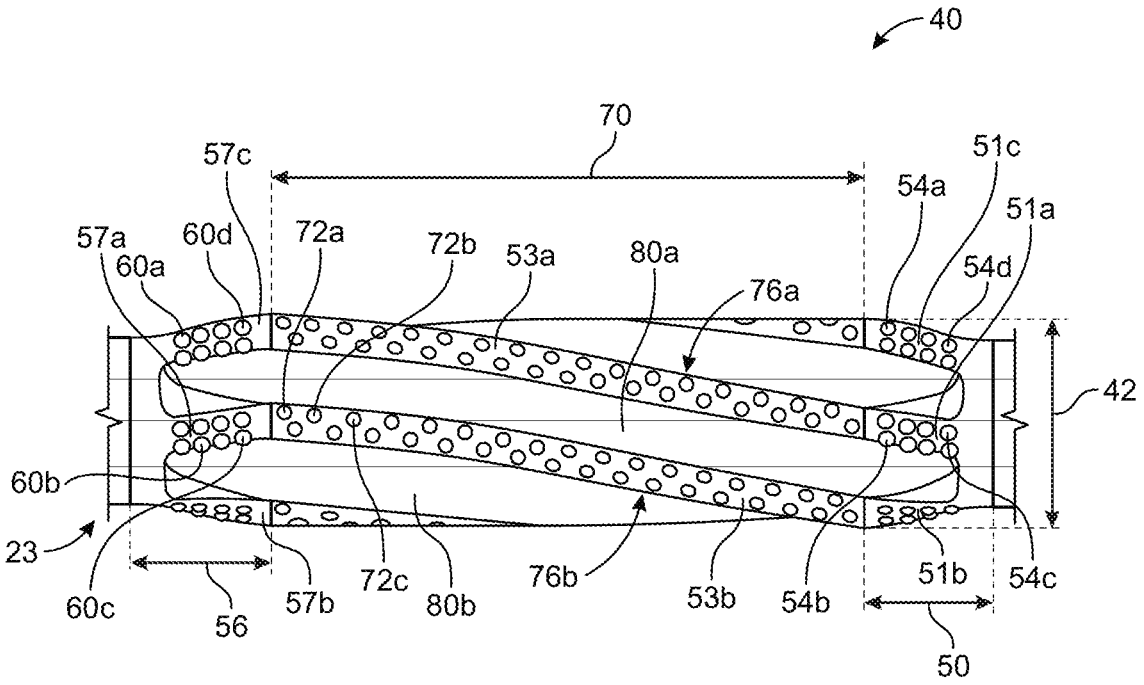
FIGS. 2A and 2B are detailed perspective views of a cutting section of the first outer wear band of FIG. 1A and a cutting section of the second outer wear band of FIG. 1B, respectively, according to one or more embodiments.
Figure 2B:
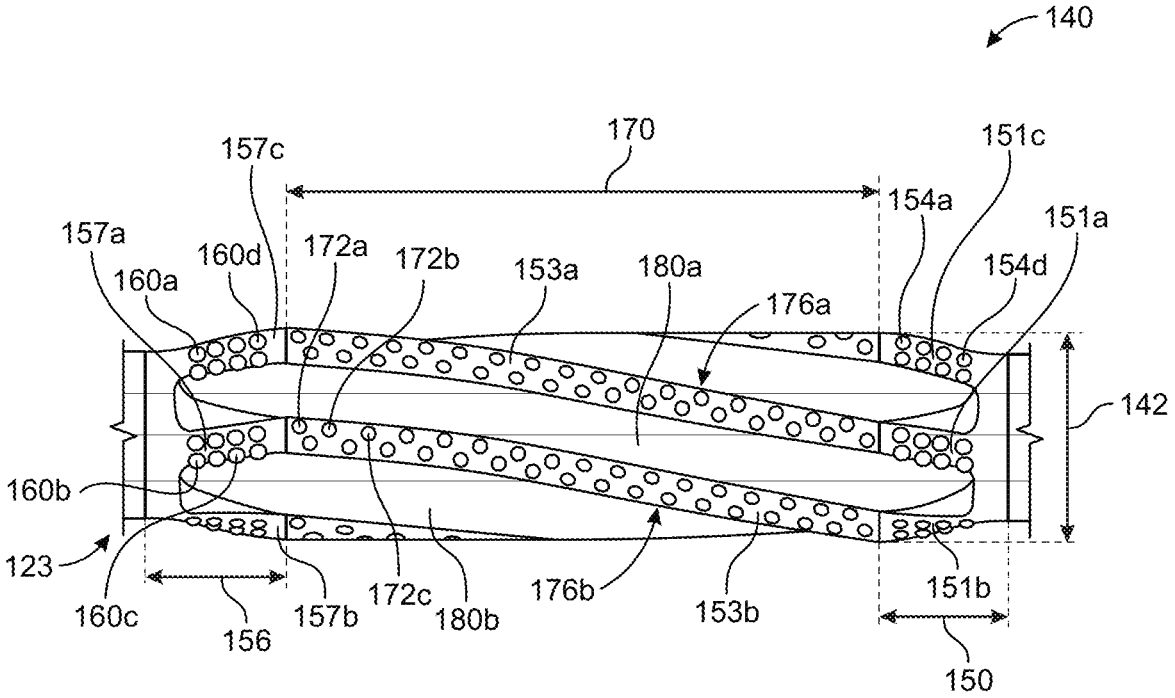

FIGS. 2A and 2B are detailed perspective views of the first cutting section 40 of the first outer wear band 20 and the second cutting section 140 of the second outer wear band 120, respectively, according to one or more embodiments.

FIG. 2A shows two formed first blades, and the two blades as labelled elements 76*a* and 76*b*.

Each of the two formed blades is integrally formed from the first shaft 22. Individual blades have a first cutting portion segment 51*a*, 51*b* and 51*c* in a first cutting portion 50 of the first cutting section 40.

The first cutting section 40 has a first cutting section outer diameter 42.

Each of the blades has a second cutting segment 57*a,b,c* in a second cutting portion segment 56 of the first cutting section 40.

Each of the blades has a first blade outer surface 53*a, b*, between one of the first cutting portion segments 51*a, b, c* and one of the second cutting segments 57*a, b, c*.

The first cutting portion 50 extends from the first blade-free fitting section 30, shown in FIG. 1A, at a first cutting angle 203 from the longitudinal axis 24 (shown in FIG. 8) to a first blade outer surface 53*a* and 53*b* shown in FIG. 2A.

Each first cutting portion segment 51*a, b, c* has a plurality of first cutting inserts 54*a*-54*d* are labelled. Other first cutting inserts are shown but not labelled.

Figure 8:
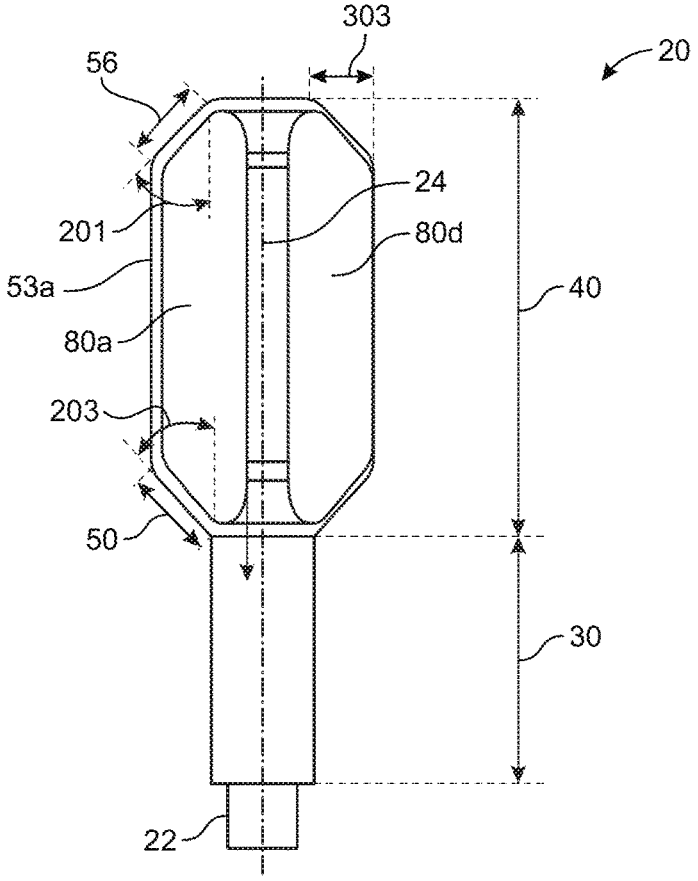
FIG. 8 depicts a side view of the first outer wear band.

Jumping to FIG. 8 each second cutting portion segment extends at a second cutting angle 201 from the longitudinal axis 24 to the first blade outer surface 53*a* and 53*b*.

Returning to FIG. 2A, each second cutting portion segment 56 of each blade has a plurality of second cutting inserts 60*a-d*.

Importantly, the first cutting portion 50 and the second cutting portion segment 56 are formed at cutting angles from about 10 degrees to about 55 degrees from the longitudinal axis 24 shown in FIG. 1A.

Returning to FIG. 2A, first cutting section 40 has a first blade cutting portion 70 integrally formed between first cutting portion 50 and second cutting portion segment 56 forming a plurality of a first blades 76*a, b*. Each first cutting section 40 can have, in embodiments, from 1 to 8 first blades 76*a, b* formed on the first shaft 22.

Each first blade cutting portion 70 has a plurality of first blade cutting inserts 72*a*, 72*b*, and 72*c* mounted into each first blade outer surface 53*a* and 53*b*.

Each first blade cutting insert 72*a, b, c* can be domed tungsten carbide cutting inserts, raised tungsten carbide cutting inserts, polycrystalline diamond compacts, polished polycrystalline diamond compacts, diamond hard facing cladding, and combinations thereof.

FIG. 2A shows a plurality of first flutes 80*a* and 80*b* formed between pairs of first blades 76*a, b*.

The first shaft 22, shown in FIG. 1A, has a second end 23 opposite the first blade free fitting section 30.

FIG. 2B shows two formed second blades 176*a, b*.

Each of the formed second blades 176*a, b* is integrally formed from the second shaft 122. Individual formed second blades 176*a, b* have a second blade first cutting portion segments 151*a*, 151*b* and 151*c* in a second outer wear band blade first cutting portion 150 of the second cutting section 140.

The second cutting section 140 has a second cutting section outer diameter 142.

Each of the formed second blades 176*a, b* has a second cutting segment 157*a, b, c* in a second outer wear band second cutting portion segment 156 of the second cutting section 140.

Each of the formed second blades 176*a, b* has a first blade outer surface 153*a,b*, between one of the first cutting portion segments 51*a, b, c* and one of the second cutting segments 157*a, b, c*.

The second outer wear band blade first cutting portion 150 extends from the second blade-free fitting section 130, at a second outer wear band first cutting angle 152 from the second outer wear band longitudinal axis 124 (shown in FIG. 7) to a first blade outer surface 153*a* and 153*b* shown in FIG. 2A.

Returning to FIG. 2B, each second outer wear band second blade first cutting portion segment 151*a*, 151*b*, 151*c* is shown having a plurality of second outer wear band first cutting inserts 154*a-d*. Other cutting inserts are shown but not labelled.

The second outer wear band second cutting portion segment 156 contains a plurality of second outer wear band second cutting inserts 160*a-d* mounted into the second outer wear band second cutting portion.

It should be noted as shown in FIG. 2B, the second outer wear band first cutting portion 150 and the second outer wear band second cutting portion segment 156 are formed at a cutting angle from about 10 degrees to about 55 degrees from the second outer wear band longitudinal axis 124 shown in FIG. 1B.

Each second outer wear band second blade cutting portion 170 has a plurality of second outer wear band second blade cutting inserts, 172*a*, 172*b*, and 172*c* areas shown mounted into each second outer wear band second first blade outer surface 153*a* and 153*b*.

Each second outer wear band cutting blade insert 172*a, b, c* can be domed tungsten carbide cutting inserts, raised tungsten carbide cutting inserts, polycrystalline diamond compacts, polished polycrystalline diamond compacts, diamond hard facing cladding, and combinations thereof.

FIG. 2B shows plurality of second outer wear band second flutes 180*a* and 180*b* formed between pairs of second outer wear band first blades 176*a, b*.

In embodiments, the first outer wear band 20 and the second outer wear band 122 attach to the drill string 16 as shown in FIG. 9 and rotate independently of each other as the first outer wear band 20 engages the drill string 16 in a first direction of rotation and the second outer wear band 120 engages the drill string 16 in an opposite direction of rotation stabilizing and protecting the bottom hole assembly 12 while the wellbore 14 is enlarged while completing directional objectives.

The second shaft 122 has a second end 123 opposite the second blade free fitting section 130.

FIGS. 3A and 3B depict cross sectional views of the cutting section of the first outer wear band 20 with cutting inserts and a cutting section of the second outer wear band 120 with cutting inserts, respectively according to one or more embodiments.

FIGS. 3A and 3B show a first outer wear band 20 formed from a first shaft 22 defining a first annulus 26 with a first inner diameter 28. The second outer wear band 120 is shown with a second shaft 122 defining a second annulus 127 with a second inner diameter 128.

FIGS. 3A and 3B show a connected communication wire 205 in the first shaft 22 near but not within annulus 26 that continues into the second shaft 122 near but not within annulus 127 of the second shaft in a manner not shown.

FIGS. 3A and 3B show impact arrestors 260*a* and 260*b*, leading edge blade cutting inserts 261*a* and 261*b*, and recessed blade cutting inserts 263*a* and 263*b* on the first shaft 22, and recessed blade cutting inserts 263*c* and 263*d* on the second shaft 122.

FIGS. 3A and 3B show an electronegative layer 555*a* on first shaft 22 and an electronegative layer 555*b* on the second shaft 122.

It is contemplated that an electronegative charge layer 555 can be formed within about 1% to about 15% of the surface of the shaft using ammonium nitrate and heat for reducing balling tendencies while drilling with the outer wear band.

FIGS. 3A and 3B show plurality of leading-edge blade cutting inserts 72*a* and 72*d* can be installed on a leading edge of each the blade.

blade Leading edge blade cutting insert 72*a* on the second shaft 122 and leading edge cutting insert 72*d* is on the first shaft 22.

Figure 4A:
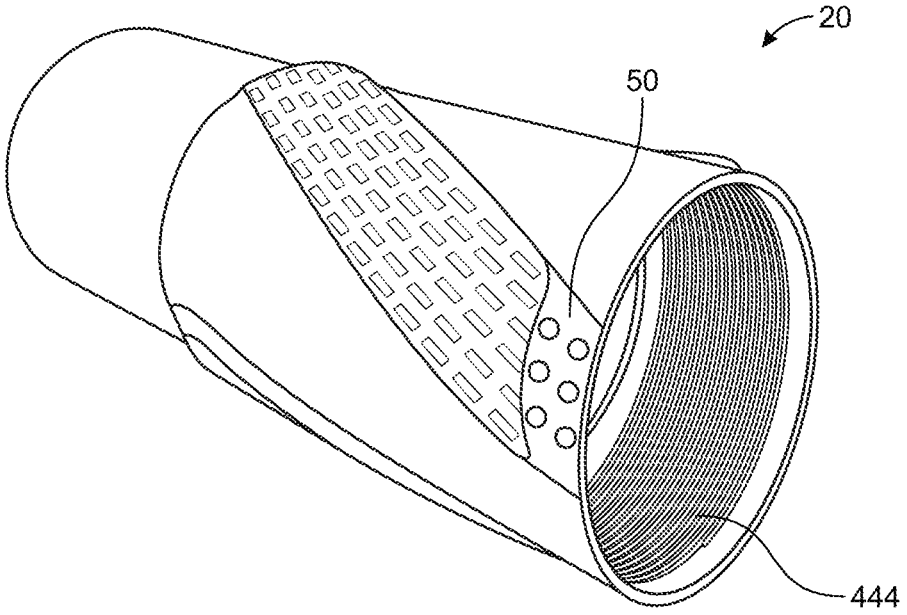
FIGS. 4A and 4B depict a front perspective view of first outer wear band and second outer wear band according to one or more embodiments.
Figure 4B:
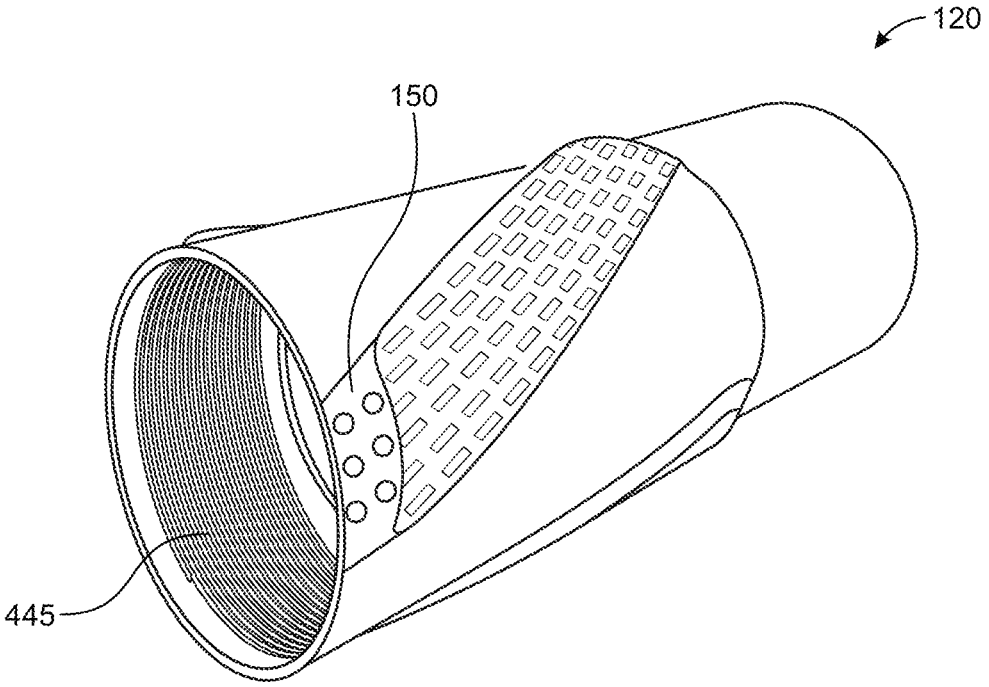

FIGS. 4A and 4B depict a front perspective view of first outer wear band 20 and a front perspective second outer wear band 120 according to one or more embodiments.

The first outer wear band 20 has a first cutting portion 50 labelled.

The first outer wear band 20 is shown with first engagement threads 444.

The second outer wear band 120 is shown with a second outer wear band first cutting portion 150 and second engagement threads 445.

The first engagement threads 444 have a cut in a first direction, such as clockwise, and the second engagement threads 445 have a cut in an opposite second direction, such as counterclockwise.

The blades formed in the cutting section are presented in a helically embodiment in these FIGS. 4A and 4B.

Figure 5A:
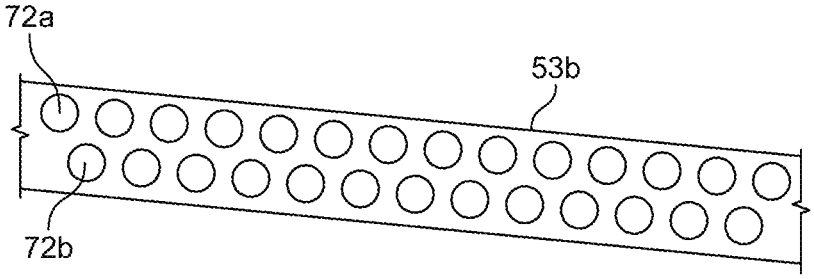
FIGS. 5A and 5B depict cutting insert configuration embodiments according to one or more embodiments.
Figure 5B:
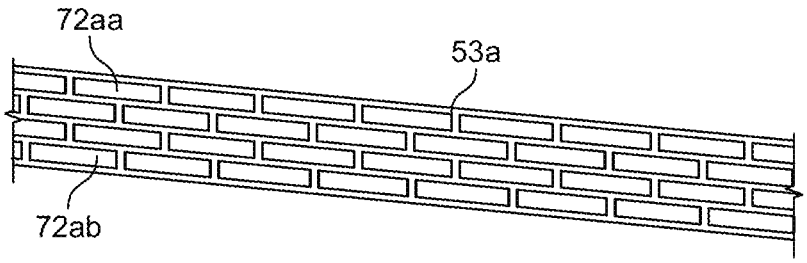

FIGS. 5A and 5B depict cutting insert configuration embodiments according to one or more embodiments.

FIG. 5A depicts first blade outer surface 53*b* with first blade cutting inserts 72*a* and 72*b* and adjacent first cutting blade inserts in a staggered but parallel round cutting insert configuration.

FIG. 5B depicts a different first blade outer surface 53*a*, with first blade cutting inserts 72*aa* and 72*ab* in a staggered but parallel rectangular cutting insert configuration.

Figure 6:
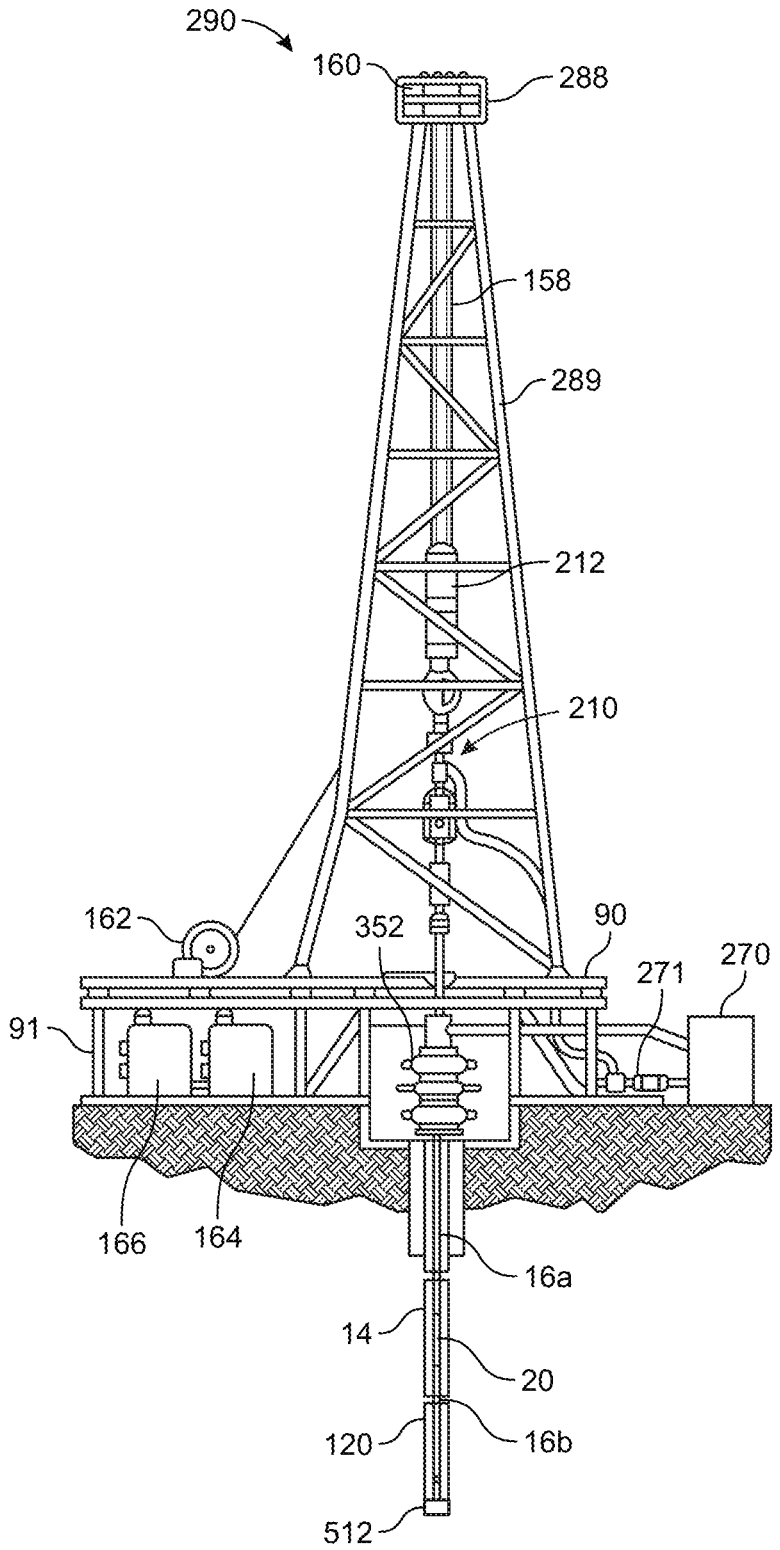
FIG. 6 depicts a side view of a drilling rig with the attached first outer wear band and second outer wear band.

FIG. 6 depicts a side view of a drilling rig 290 deploying the attached first outer wear band 20 and second outer wear band 120.

The drilling rig 290 has improved safety by having a first and second outer wear band connected to downhole components according to one or more embodiments.

The ruggedized tool for the drilling rig 290 is made of the first and second outer wear bands 20, 120 and can be configured to simultaneously smooth the wellbore 14, centralize the downhole components from wear and damage, and flow drilling fluid to at least one downhole component or at least one operating component while allowing wellbore fluid to flow to a surface unimpeded.

FIG. 6 shows the drilling rig 290 with a tower 289 having a crown 288 with a plurality of sheaves 160.

In embodiments, the tower 289 can be a derrick. The tower 289 can have a rig floor 90 and a rig floor substructure 91.

The drilling rig 290 can have a drawworks 162 connected with a drawworks motor 164 connected to a power supply 166.

A cable 158 can extend from the drawworks 162 through the plurality of sheaves 160 over the crown 288. A lifting block 212 can be connected to the cable 158.

A hydraulic pump 271 can be fluidly connected to a tank 270 for flowing fluid into the wellbore 14 as drill pipe forming a drill string 16 (shown in FIG. 9) formed from drill pipe sections 16*a* and 16*b*, is turned into the wellbore 14.

A rotating means 210 can be used for turning drill pipe sections into the wellbore. The rotating means 210 is depicted as either a top drive or a power swivel mounted to the lifting block.

In other embodiments, the rotating means can be a rotary table mounted to a rig floor for rotating drill pipe into a wellbore.

A blowout preventer 352 can be connected between the rotating means 210 and the wellbore 14 for receiving drill pipe.

The first outer wear band 20 is depicted mounted between a first drill pipe section 16*a* and a second drill pipe section 16*b*. The second outer wear band 120 is between the second drill pipe section 16*b* and a measurement while drilling assembly 512 of the bottom hole assembly.

Figure 7:
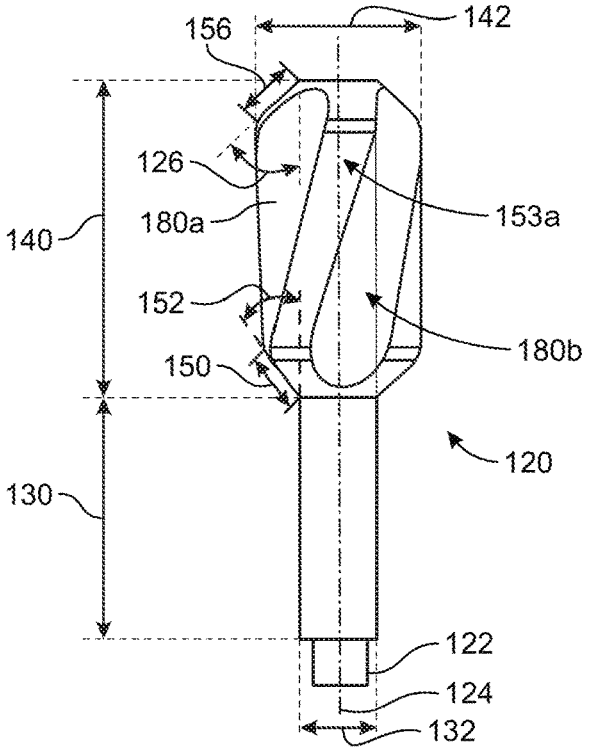
FIG. 7 depicts a side view of the second outer wear band.

FIG. 7 depicts a side view of the second outer wear band 120.

In this embodiment, the blades are presented in a helical configuration.

The second shaft 122 is depicted with second outer wear band longitudinal axis 124.

The second outer wear band 120 has second blade-free fitting section 130 integral with the second cutting section 140. The second cutting section 140 has a second outer wear band first cutting portion 150 is at a second outer wear band first cutting angle 152 to the second outer wear band longitudinal axis 124.

The second cutting section 140 has a second cutting section outer diameter 142 that is larger than the outer diameter of the drill string thereby permitting cutting within the wellbore.

The second cutting section outer diameter 142 of the second blade-free cutting section 132 is smaller than the second cutting section outer diameter 142.

The second outer wear band first cutting portion 150 is integral with the second outer wear band second first blade outer surface 153*a*.

The second outer wear band second first blade outer surface 153*a* is integrally formed with a second outer wear band second cutting portion segment 156.

The second outer wear band second cutting portion segment 156 is formed on an angle 126 to the second outer wear band longitudinal axis 124.

The second outer wear band 120 has a plurality of second flutes 180*a*, 180*b*. The flutes 180*a*, 180*b* are positioned between pairs of second outer wear band first blades 176*a, b*. The second outer wear bland first blades 176*a, b* are formed from second outer wear band first cutting portion 150, second outer wear band first blade outer surface 153*a*, and second outer wear band second cutting portion segments 156.

FIG. 8 depicts a side view of the first outer wear band 20.

The first shaft 22 supports an integral first blade-free fitting section 30 that integrally engages the first cutting section 40.

A first cutting portion 50 extends from the first blade-free fitting section 30. The first cutting portion 50 extends at a first cutting angle 203 from the longitudinal axis 24.

A second cutting portion segment 56 extends from the first shaft 22 on an end opposite the first blade-free fitting section 30.

The second cutting portion segment 56 extends a second cutting angle 201 from the longitudinal axis 24.

Integral with and attached between the first and second cutting portions is a first blade outer surface 53*a* forming a first blade 76, b.

Between pairs of first blades 76*a, b*, is a first flute 80*a*. Two first flutes 80*a, d* are shown between different pair of first blades 76*a, bs*

A thickness 303 for each of the first and second cutting portion segments 50, 56 is labelled.

FIG. 9 depicts a first outer wear band 20 attached to a bottom hole assembly 12 on one end, and a segment of drill string 16*b* on an opposite end while working in a wellbore 14.

FIG. 9 shows the second outer wear band 120 mounted to the drill string 16 in an opposite orientation from the first outer wear band 20, that is, as a mirror image to the first outer wear band 20.

The second outer wear band 120 is attached to the same segment of drill string 16*b* on the second blade-free fitting section 130, shown in FIG. 1B, as the first outer wear band 20.

The second outer wear band 120 is attached to a different segment of the drill string 16 on the second cutting section 140 while both outer wear bands 20, 120 are contained in the well bore 14.

Figure 10:
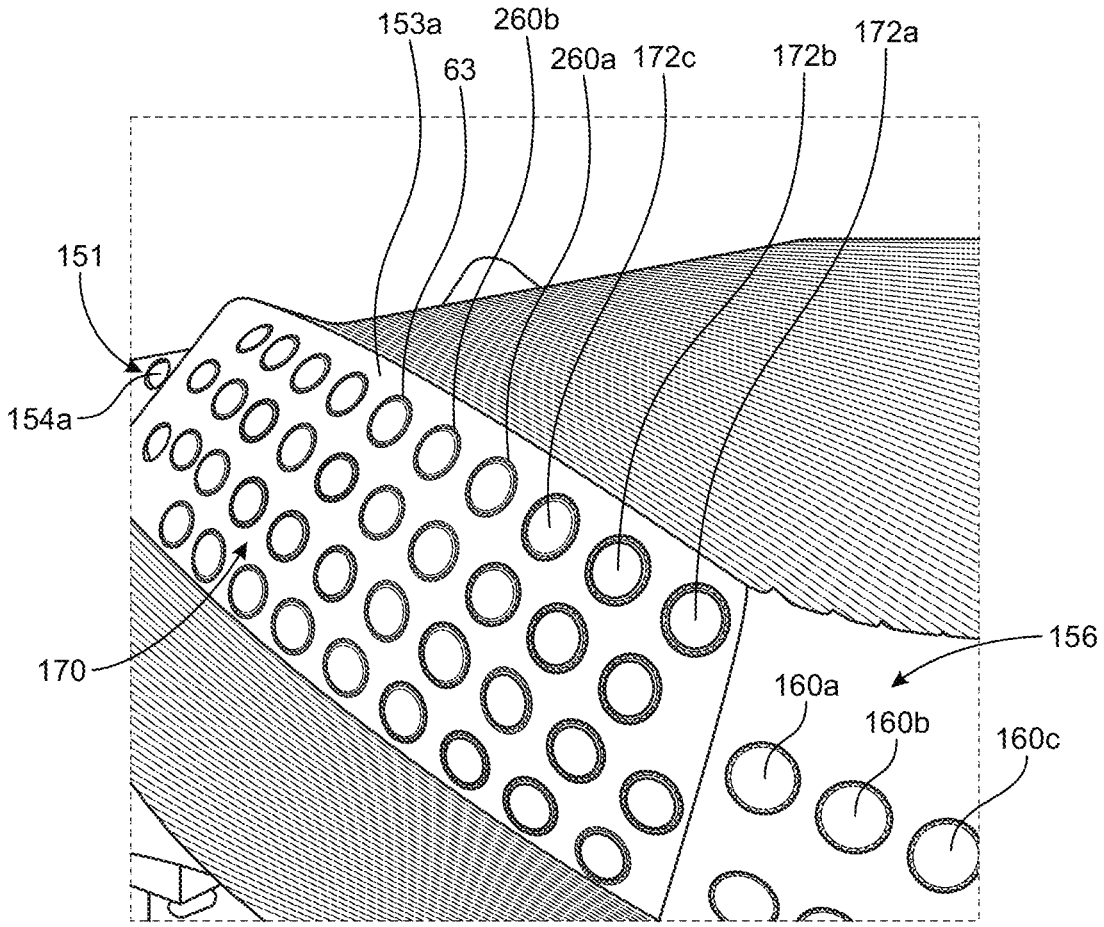
FIG. 10 depicts a detailed view of a cutting surface of a second outer wear band with the second outer wear band second cutting portion integrally formed with the second outer wear band second blade cutting portion which is integrally formed with the second outer wear band first cutting portion of a blade.

FIG. 10 depicts a detailed view of a cutting surface 153*a* of a second outer wear band with the second outer wear band second cutting portion segment 156 integrally formed with the second outer wear band second blade cutting portion 170 which is integrally formed with the second outer wear band first cutting portion segment 151.

The second outer wear band first cutting portion segment 151 has second outer wear band first cutting inserts, one of which is labelled as 154*a*. It should be noted that more than one second outer wear band first cutting insert can be used in embodiments.

In each of these cutting portion segments 151*a, b, c*, cutting inserts 154*a-d* can be mounted within pre-machined holes, one of the holes is labelled as element 63.

In embodiments, first blade cutting inserts have diameters from about $3/8^{th}$ inch to about 1 inch for a friction fit in one of a plurality of pre-machined holes 63 drilled in the first blade providing a flush engagement of the cutting insert with the first blade outer surface.

Second outer wear band cutting portion segment 156 has second outer wear band second cutting inserts 160*a*, 160*b* and 160*c*.

The second outer wear band second blade cutting portion 170 has second outer wear band second blade cutting inserts 172*a*, 172*b*, and 172*c* as well as impact arrestors 260*a* and 260*b* mounted into the second outer wear band first blade outer surface 153*a*.

Figure 11:
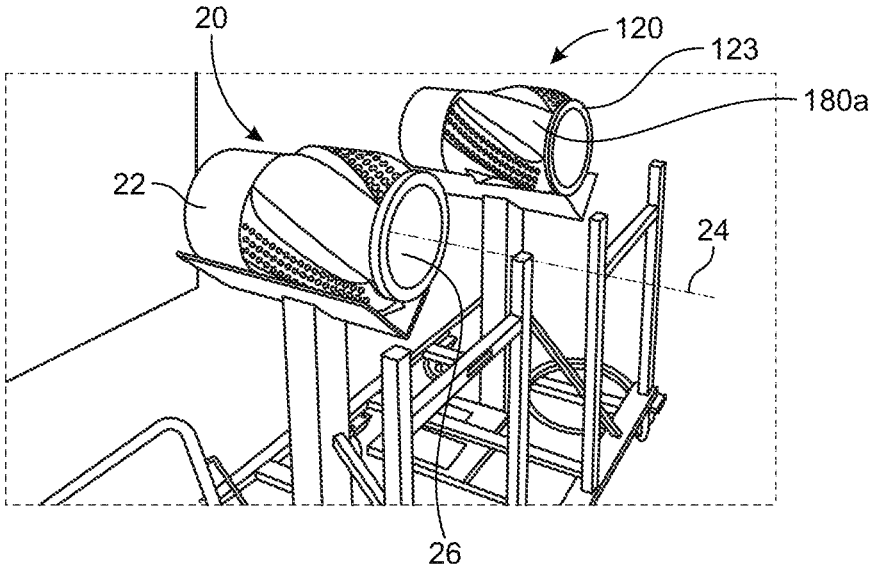
FIG. 11 depicts a perspective view of a first outer wear band and a second outer wear band mounted adjacent each other with identical lengths, widths and diameters.

FIG. 11 depicts a perspective view of a first outer wear band 20 and a second outer wear band 120 mounted adjacent each other with identical lengths, widths and diameters.

In FIG. 11 the first outer wear band 20 is shown having a first shaft 22 and a first annulus 26 with a longitudinal axis 24.

FIG. 11 also depicts a second outer wear band 120 mounted adjacent the first outer wear band with identical lengths, widths and diameters.

The second outer wear band 120 includes second flute 180*a* and the second end 123.

Figure 12:
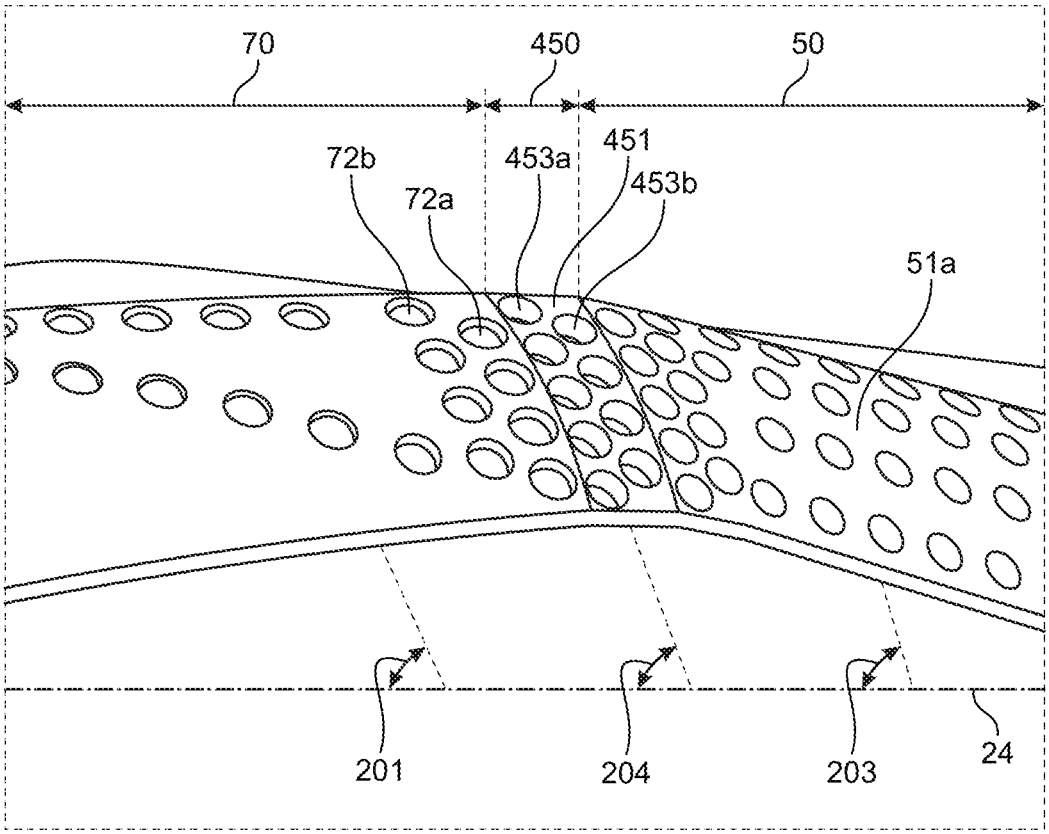
FIG. 12 depicts a detailed view of a first blade with an extension installed between the blade cutting portion and the first cutting portion.

FIG. 12 depicts a detailed view of a first blade with an extension 450 installed between the first blade cutting portion 70 and the first cutting portion 50.

The extension 450 and an extension angle 204 from the longitudinal axis 24. The extension angle 204 is different from the second cutting angle 201, and from the first cutting angle 203.

In embodiments, the extension angle 204 is different from both the second cutting angle 201 and the first cutting angle 203.

In this FIG. 12 the first cutting portion 50 has a cutting portion segments 51*a*.

FIG. 12 shows the first blade cutting portion 70 with a plurality of second outer wear band first blade cutting inserts 72*a* and 72*b*.

The extension 450 includes a cutting extension surface 451, which is at a different angle than the two adjacent surfaces of the first cutting portion 50 and the first blade cutting portion 70.

Installed in the extension 450 are a plurality of extension cutting inserts 453*a* and 453*b*. The extension 450 has a plurality of extension machined holes not otherwise shown for containing the extension cutting inserts 453*a*, 453*b*. The extension cutting inserts 453*a*, 453*b* are, in this particular embodiment, identical to the first cutting inserts, the second cutting inserts, or the first blade cutting inserts.

Example 1—Single Outer Wear Band

A ruggedized bidirectional cutting system for protecting and engaging a bottom hole assembly attached to a drill string, namely a rotary steerable drilling system with a downhole motor in combination with a measurement while drilling system in a wellbore having a depth to target of from 5000 feet to 50,0000 feet has a first outer wear band that is attached on a first blade-free fitting section to the drill string. The drill string is made from 2 to 7 inch outer diameter drill pipe that is connected together by a drill rig (as shown in FIG. 6) using a power swivel.

The first outer wear band is 24 inches in length along a longitudinal axis.

The first outer wear band is formed from first shaft that slips around another downhole component, namely the downhole motor. The first outer wear band then threads to a drill pipe in the drill string on one end.

The first shaft is concentrically centered around the longitudinal axis.

The first shaft has a first annulus with a 9.28 inch inner diameter that enables flow of drilling fluid.

The first outer wear band has a first blade-free fitting section with a length of 5 inches and an outer diameter of 10.75 inches.

The first outer wear band has a first cutting section 12 inches and a first cutting section outer diameter at its largest of 17.2 inches outer diameter and has 5 first blades with 5 flutes positioned between pairs of blades. The first cutting section formed integrally with the first blade-free fitting section.

Each first blade is formed from a first cutting portion that is 4 inches in length extending from the first blade-free fitting section at a first cutting angle of 25 degrees from the longitudinal axis.

The first cutting portion has 4 first cutting inserts. Each first cutting insert is ½ inch in diameter and made from tungsten carbide.

The first blade cutting portion is formed integrally with the first cutting portion at a third cutting angle 45 degrees from the longitudinal axis, which is a different angle from the first cutting angle.

The first blade cutting portion can be 8 inches in length.

The blade cutting portion has 30 blade cutting inserts each having a diameter of ½ each, and each blade cutting insert made from polycrystalline diamond compact.

A second cutting portion is formed integrally with the first blade cutting portion extending at a second cutting angle 25 degrees from the longitudinal axis. The second cutting portion has 12 second cutting inserts each having a diameter of ½ inch and made from domed tungsten carbide.

First flutes are formed between pairs of first blades five are formed in this example.

Each flute is 17 inches long. Each flute is elliptical and tapered at the ends. Each flute is cut 2% into the thickness of the first shaft.

Example 2—Single Outer Wear Band with Extensions

A ruggedized bidirectional cutting system for protecting and engaging a bottom hole assembly attached to a drill string, namely a downhole motor in combination with a measurement while drilling system in a wellbore having a depth to target of from 5000 feet to 50,0000 feet has a first outer wear band that is attached on a first blade-free fitting section to the drill string. The drill string is made from 2 to 7 inch outer diameter drill pipe that is connected together by a drill rig (as shown in FIG. 6) using a power swivel.

The first outer wear band is 40 inches in length along a longitudinal axis.

The first outer wear band is formed from first shaft that slips around another downhole component, namely a downhole motor. The first outer wear band then threads to a drill pipe in the drill string on one end.

The first shaft is concentrically centered around the longitudinal axis.

The first shaft has a first annulus with a 6 inch inner diameter that permits flow of drilling fluid.

The first outer wear band has a first blade-free fitting section with a length of 3 inches and an outer diameter of 6.75 inches.

The first outer wear band has a first cutting section 30 inches in length and a first cutting section outer diameter at its largest of 8.75 inches outer diameter.

In this example, the first cutting section has 4 first blades with 4 flutes positioned between pairs of blades. The first cutting section is formed integrally with the first blade-free fitting section.

Each first blade includes a first cutting portion that is 3 inches in length extending from the first blade-free fitting section at a first cutting angle of 25 degrees from the longitudinal axis.

The first cutting portion has 6 first cutting inserts. Each first cutting insert is ½ inch in diameter and made from tungsten carbide.

Two extensions are used to make the first outer wear band in this example.

A first extension is 3 inches in length and integrally formed between the blade cutting portion and the first cutting portion of each first blade. The first extension has 30 cutting inserts made from polycrystalline diamond compacts each having a diameter of ½ inch.

The first extension has the cutting inserts mounted into each of 30 extension machined holes for containing one of the extension cutting inserts permitting the cutting inserts to be flush mounted on the first extension. The first extension is formed at a 30 degree angle from the longitudinal axis.

The first blade cutting portion is formed integrally with first cutting portion at a third cutting angle 35 degrees from the longitudinal axis, which is a different angle from the first extension.

The first blade cutting portion is 6 inches in length.

The blade cutting portion has 25 blade cutting inserts each having a diameter of ¼ each, and each blade cutting insert made from polycrystalline diamond compact.

A second extension joined with to the first blade cutting portion is 3 inches in length and integrally formed between the blade cutting portion and a second cutting portion of each first blade. The second extension has 20 cutting inserts made from polycrystalline diamond compacts each having a diameter of ¼ inch.

The second extension has the cutting inserts mounted into each of 20 extension machined holes for containing one of the extension cutting inserts permitting the cutting inserts to be extending 0.15 inch from the surface of the second extension. The second extension is formed at a 30 degree angle from the longitudinal axis.

A second cutting portion is formed integrally with the second extending and extends at a second cutting angle 25 degrees from the longitudinal axis. The second cutting portion has 12 second cutting inserts each having a diameter of ½ inch and made from domed tungsten carbide.

First flutes are formed between pairs of first blades four are formed in this example.

Each flute is 28 inches long. Each flute is elliptical and tapered at the ends. Each flute is cut 5% into the thickness of the first shaft.

Example 3—Dual Outer Wear Bands Wherein Both Outer Wear Bands are Identical

In this example, a first outer wear band discussed in Example 2 is exactly copied to form a second outer wear band.

In this example, to use the dual outer wear bands that are identical, a drill pipe runs to surface, and the drill string is formed of a connecting heavy weight drill pipe, that engages a nonmagnetic drill collar, a measurement while drilling system, a rotary steerable system threaded to first outer wear band on one end using first engagement threads and the second outer wear band is threaded on the opposite end to the rotary steerable system with second engagement threads.

What is claimed is:

1. A ruggedized bidirectional cutting system for protecting and engaging a bottom hole assembly in a wellbore comprising:

a first outer wear band engaged with a drill string at a first location in the drill string and having a first orientation relative to the drill string;

a second outer wear band engaged with the drill string at a second location in the drill string and having a second orientation with respect to the drill string such that the second orientation of the second outer wear band is a mirror of the first orientation of the first outer wear band, the first outer wear band comprising:

a first shaft for slipping around a first downhole component, prior to threading the first downhole component to a first drill pipe or other downhole component in the drill string, the first shaft centered around a longitudinal axis, the first shaft having a first inner bore with a first inner diameter, the first shaft to surround and protect the first downhole component surrounded therein;

a first blade-free fitting section formed on the first shaft to threadably engage the drill string;

a first cutting section integral with the first blade-free fitting section, the first cutting section having a first cutting section outer diameter and a plurality of first blades, each first blade comprising:

a first cutting portion extending from the first blade-free fitting section at a first cutting angle from 10 degrees to 55 degrees from the longitudinal axis, the first cutting portion comprising a plurality of first cutting inserts;

a first blade cutting portion integrally formed with the first cutting portion at a third cutting angle from the longitudinal axis different from the first cutting angle, the first blade cutting portion comprising a plurality of first blade cutting inserts;

a second cutting portion segment formed integrally to the first blade cutting portion and extending at a second cutting angle from 10 degrees to 55 degrees from the longitudinal axis and comprising a plurality of second cutting inserts, wherein each first cutting insert and each second cutting insert is a domed tungsten carbide cutting insert, a raised tungsten carbide cutting insert, a polycrystalline diamond compact, a polished polycrystalline diamond compact, a diamond hard facing cladding, or a combination thereof; and a plurality of first flutes, each first flute formed between pairs of the first blades, wherein the first outer wear band is engaged with the drill string at the first downhole component to stabilize and protect the bottom hole assembly while the wellbore is enlarged completing directional drilling objectives;

the second outer wear band comprising:

a second shaft for slipping around a second downhole component, prior to threading the second downhole component to a second drill pipe or other downhole component in the drill string, the second shaft centered around a second outer wear band longitudinal axis, the second shaft having a second inner bore with a second inner diameter, the second shaft to surround and protect the second downhole component surrounded therein;

a second blade-free fitting section formed on the second shaft to threadably engage the drill string;

a second cutting section integral with the second blade-free fitting section, having second cutting section outer diameter; a plurality of second blades, each second blade comprising:

a second outer wear band first cutting portion extending from the second blade-free fitting section at a second outer wear band first cutting angle from 10 degrees to 55 degrees from the second outer wear band longitudinal axis, the second outer wear band first cutting portion comprising a plurality of first cutting inserts;

a second outer wear band second blade cutting portion integrally formed with the second outer wear band first cutting portion at a third cutting angle from the longitudinal axis different from the second outer wear band first cutting angle, the blade cutting portion comprising a plurality of cutting inserts; and a second outer wear band second cutting portion segment integrally formed with the second outer wear band first blade cutting portion extending at a second cutting angle from 10 degrees to 55 degrees from the longitudinal axis and comprising a plurality of second outer wear band second cutting inserts, wherein each of the second cutting inserts is a domed tungsten carbide cutting insert, a raised tungsten carbide cutting insert, a polycrystalline diamond compact, a polished polycrystalline diamond compact, a diamond hard facing cladding, or a combination thereof; and a plurality of second outer wear band second flutes formed between pairs of second outer wear band first blades, wherein the second outer wear band is engaged with the drill string at the second downhole component, wherein:

the first downhole component and the second downhole component are either a downhole motor or a rotary steerable tool, the second outer wear band acts independently of the first outer wear band stabilizing and protecting the bottom hole assembly while the wellbore is enlarged completing directional objectives, and the first location in the drill string and the second location in the drill string are separated by at least one intervening tool on the drill string.

2. The ruggedized bidirectional cutting system of claim 1, wherein a first engagement thread is formed in a first direction in the first inner diameter of the first outer wear band for engaging the drill string at the first location and a second engagement thread is formed in a second direction in the second inner diameter of the second outer wear band for engaging the drill string at the second location.

3. The ruggedized bidirectional cutting system of claim 1, wherein the first and second cutting angles are identical in degrees and are at equivalent angles between 10 degrees and 50 degrees.

4. The ruggedized bidirectional cutting system of claim 1, wherein the first blades are helically disposed about the longitudinal axis of the first shaft.

5. The ruggedized bidirectional cutting system of claim 1, wherein the bottom hole assembly includes a measurement while drilling assembly and the first outer wear band engages the measurement while drilling assembly connected to the drill string while the second outer wear band simultaneously engages the drill string and another downhole tool.

6. The ruggedized bidirectional cutting system of claim 1, wherein at least one of the first cutting insert and the second cutting insert includes 1 to 35 polycrystalline diamond compacts installed in the first cutting portion, the second cutting portion, or the blade cutting portion.

7. The ruggedized bidirectional cutting system of claim 1, wherein first cutting inserts comprise diameters from $3/8^{th}$ inch to 1 inch for a friction fit in one of a plurality of pre-machined holes drilled in the first blade providing a flush engagement with a first blade outer surface.

8. The ruggedized bidirectional cutting system of claim 7, comprising a plurality of leading edge blade cutting inserts installed on a leading edge of each first blade.

9. The ruggedized bidirectional cutting system of claim 1, comprising a plurality of leading edge blade cutting inserts installed on a leading edge of each second outer wear band first blade.

10. The ruggedized bidirectional cutting system of claim 1, comprising from 2 to 100 blade cutting inserts installed in pre-machined holes on the first blade.

11. The ruggedized bidirectional cutting system of claim 1, comprising from 3 to 300 blade cutting inserts installed in pre-machined holes on both the first and second outer wear bands.

12. The ruggedized bidirectional cutting system of claim 1, comprising a plurality of recessed blade cutting inserts installed on each of: the first blade and the second blade at depths from 10% to 50% of the thickness of each blade.

13. The ruggedized bidirectional cutting system of claim 12, wherein the plurality of recessed blade cutting inserts are installed at an offset of 1 degree to 15 degrees from a plane formed by each blade outer surface, the offset tilting the recessed blade cutting inserts into a direction of rotation of the outer wear band to minimize rotation friction as the outer wear band rotates.

14. The ruggedized bidirectional cutting system of claim 1, comprising an extension integrally formed between the first blade cutting portion and the first cutting portion of each first blade; the extension comprising a plurality of extension machined holes for containing extension cutting inserts formed into a portion of the cutting extension surface, wherein the extension cutting inserts are identical to the first cutting inserts, the second cutting inserts, or the first blade cutting inserts.

15. The ruggedized bidirectional cutting system of claim 1, wherein the blade-free fitting section comprises from 10% to 60% of a length of the first shaft.

16. The ruggedized bidirectional cutting system of claim 1, wherein each outer wear band is eccentrically positioned around the longitudinal axis of each shaft.

17. The ruggedized bidirectional cutting system of claim 1, comprising a plurality of impact arrestors imbedded in portions of the first blade or the second blade, each impact arrestor being a tungsten carbide arrestor, a ceramic impact arrestor, a polycrystalline diamond impact arrestor, a domed polycrystalline diamond compact arrestor or a diamond impregnated impact arrestor.

18. The ruggedized bidirectional cutting system of claim 1, comprising a connected communication wire in each inner bore of each outer wear band.

19. The ruggedized bidirectional cutting system of claim 1, comprising an electronegative layer formed within 1% to 15% of the surface of the first shaft using ammonium nitrate and heat for reducing balling tendencies while drilling with the outer wear band.

20. The ruggedized bidirectional cutting system of claim 1, wherein each cutting insert has a geometric shape that is round, rectangular, square, triangular, octagonal, or trapezoidal.

* * * * *